US005082151A

United States Patent [19]

Schaerer

[11] Patent Number: 5,082,151

[45] Date of Patent: Jan. 21, 1992

[54] METHOD AND APPARATUS FOR WINDING ROUND THE STEM OF A BUTTON SEWN ONTO AN ARTICLE OF CLOTHING

[75] Inventor: André J. Schaerer, Pfaffhausen, Switzerland

[73] Assignee: Allgemeine Synthetische Gesellschaft Etablissement

[21] Appl. No.: 568,369

[22] Filed: Aug. 16, 1990

[30] Foreign Application Priority Data

Aug. 16, 1989 [DE] Fed. Rep. of Germany ..... 3927018
Feb. 16, 1990 [DE] Fed. Rep. of Germany ..... 4004877
Jul. 10, 1990 [DE] Fed. Rep. of Germany ..... 4021938

[51] Int. Cl.[5] ..... A41M 43/00
[52] U.S. Cl. ..... 223/1; 2/265; 112/108; 112/110
[58] Field of Search ..... 223/1; 112/108, 110; 2/265

[56] References Cited

U.S. PATENT DOCUMENTS 2,013,449 9/1935 Sibbald ..... 112/110
2,391,378 12/1945 Avis ..... 112/110
4,426,942 1/1984 Nestenius ..... 112/108

FOREIGN PATENT DOCUMENTS 3927018 8/1989 Fed. Rep. of Germany .
583310 12/1946 United Kingdom ..... 112/110
650107 2/1951 United Kingdom ..... 112/110
2005316 10/1978 United Kingdom .
2236046 7/1990 United Kingdom .

*Primary Examiner*—Werner H. Schroeder
*Assistant Examiner*—Bibhu Mohanty
*Attorney, Agent, or Firm*—Toren, McGeady & Associates

[57] ABSTRACT

In a method for winding round the button stem of a button sewn by a sewing thread to an article of clothing, in which a winding thread made from an elastomeric plastic is wound on under tension onto the thread bundle formed from sewing thread between the button and the article of clothing, in a simpler manner a reliable fixing of the winding thread end is brought about in that the winding thread, following the wrapping of the thread bundle, is drawn off the stem in a direction roughly at right angles to the axis with a tension increased to beyond its yield point, before the separation thereof at the button stem. The thread end extending over several coil turns is firmly fixed between the previously placed coil turn as a result of its diameter greatly reduced by complete elongation. Two embodiments of an apparatus for performing the method are also described and the apparatus is constructed as a compact, esily handleable hand-operated device.

13 Claims, 3 Drawing Sheets

METHOD AND APPARATUS FOR WINDING ROUND THE STEM OF A BUTTON SEWN ONTO AN ARTICLE OF CLOTHING

FIELD OF THE INVENTION

The invention relates to a method for winding round or wrapping a stem of a button sewn by a sewing thread to an article of clothing, in which a winding or wrapping thread made from an elastomeric plastic is wound under tension onto the thread bundle formed from the sewing thread between the button and the article of clothing and the thread end is subsequently fixed. The invention also relates to an apparatus for performing the method.

BACKGROUND OF THE INVENTION

When attaching buttons to an article of clothing, accompanied by the formation of a stem between the button and the article, a number of requirements must be satisfied, which have either not been satisfied with the hitherto-used mechanical methods or have only been satisfied by causing further problems. Thus, the button stem must be relatively stiff, but still flexible, so that on the one hand the buttons do not hang, but on the other hand when buttoning into a matching buttonhole the button can still be moved. In addition, the mechanically sewn-on button must be secured against dropping off as a result of the loosening of its winding and sewing threads. Finally, the wear action exerted by the button stem on the buttonhole is to be kept as low as possible.

DESCRIPTION OF THE PRIOR ART

In a known method comprising two working steps, the button is firstly sewn and fixed with a sewing thread accompanied by the formation of a thread bundle between the button and the article of clothing using the chain stitch method and then, with the aid of a separate machine, the thread bundle is looped with a thread using the chain stitch method. The looping of the thread bundle is not brought about by winding the thread around the bundle, but by a lateral application of the thread to the thread bundle, accompanied by the simultaneous knotting on the underside of the bundle using gripping hooks in accordance with the chain stitch method. This looping of the thread bundle by the chain stitch method causes various disadvantages. As a result of knot formation, on the underside of the thread bundle there is a one-sided thickening of the looping, which leads to friction and wear in the buttonhole. It is also disadvantageous that the knots of the chain stitch loop loosen when wearing the articles of clothing and the thread bundle consequently is no longer firmly looped, so that the buttons hang and can finally drop off.

According to another known method for fixing buttons to articles of clothing (DE 28 43 589 A1) the stem of the mechanically sewn on button is wrapped under tension with a thread, whose coil is made to swell by adding a solvent and after the evaporation of the latter is bonded accompanied by contraction, so that the button stem is firmly surrounded by a homogeneous sleeve. The winding thread is constituted by cellulose acetate yarns, which are wetted and bonded with acetone. However, although this known method leads to the stiff, durable and knot-free button stem, the application of the solvent involves an additional working step and the evaporation of the solvent is prejudicial to the health of the operators.

A method of the aforementioned type has already been described (DE 28 43 589 A1). The winding obtained by an elastic fibre winding thread surrounds the thread bundle forming the button stem in such a way that the winding exerts a constant pressure and stops the thread. However, it is correctly stated therein that it is difficult to attach the elastic yarn end. However, if the elastic winding thread end is not adequately fixed, the supple, flexible coil is detached immediately after the cutting off of the winding thread with length contraction of the tensioned elastic winding thread.

OBJECT OF THE INVENTION

The object of the present invention in the case of a method of the aforementioned type is to bring about in a simple manner a reliable fixing of the winding thread end, which prevents any reloosening of the button stem coil.

SUMMARY OF THE INVENTION

According to one aspect of the present invention, there is provided a method for winding round the stem of a button sewn by a sewing thread to an article of clothing, in which a winding thread made from an elastomeric plastics material is wound under tension onto the thread bundle formed from the sewing thread between the button and the article of clothing and the thread end is subsequently fixed, wherein, after winding round the thread bundle, the winding thread is drawn off the button stem in a direction substantially at right angles to the axis with a tension increased to beyond its yield point before it is separated at the button stem.

The present method can be performed particularly easily, because only at the end of the winding process is it necessary to increase the tensile stress of the winding thread by the indicated tension increase. The end of the elastic winding thread is drawn off vertically, i.e. roughly tangentially to the button stem circumference following the wrapping or winding process producing the stem and accompanied by the complete utilization of the elongation to beyond its yield point. As a result of the elongation of the winding thread, there is a reduction in its diameter in an inversely proportional manner to its length increase. A winding thread with a starting diameter of approximately 0.2 mm is reduced in the case of a 500% elongation to approximately 0.04 mm. On further increasing the tension in such a way that the yield point is exceeded, no further diameter decrease occurs. The increased tension acting on the winding thread is transferred prior to the reaching of the yield point, or at least immediately thereafter, to the last wound turns of the coil, which consequently also undergo an increasing diameter reduction. The turns with a greatly reduced winding thread diameter can therefore penetrate the previously made turns of the coil when increased tension is continued to be exerted thereon and are firmly embedded between the same. If now the winding thread drawn off with increased tension is separated close to the button stem, in accordance with the memory capacity of its elastomeric material, the winding thread tends to reassume its original shape, i.e. its starting diameter. As the final turns of the coil were firmly embedded under tension between already existing turns during the marked diameter reduction, the thread end cannot shorten or reach the starting diameter again. Thus, the thread end extending over several turns is firmly secured and this is helped by the twist imparted to the winding thread during the winding process and which is also irreversible as a result of the securing action. The turns of the coil formed from the winding thread cannot yield laterally, because they are on the one hand supported by the textile material of the article of clothing and on the other by the underside of the button, so that the clamping force cannot be reduced by any lateral yielding or giving way.

For separation purposes the winding thread end under increased tension on the button stem can be cut through, but preferably the winding thread is separated by tearing accompanied by an increase in the tension to the breaking limit.

The use of a winding thread with an elongation of approximately 100% to 600% , preferably 400% to 600% has proved advantageous for performing the present method.

Good results are obtained when winding threads formed from Elasthan fibres are used, such fibres having been used for decades for producing elastic clothing items and consist up to at least 85% by weight of segmented polyurethane. This material has an extraordinary abrasion resistance, a high yield point, a high elongation at break, infusibility, oxidation resistance and dry cleaning resistance.

A stationary stem winding apparatus can be used for performing the method. In the industrial manufacture of articles of clothing, it is conventional practice to sew on the buttons completely at a single work place. This process consists of two different steps, namely firstly sewing the button by means of a machine and then using a stem winding machine to wind or wrap said stem, i.e. the thread bundle forming the core of the button stem.

Both machines are normally juxtaposed in such a way that they can be operated by a single operator. However, in each case only one of the two machines is used, whilst the other is inoperative.

Therefore, to improve the economic aspect, it would be desirable for the process of sewing on buttons to be carried out continuously by one operator in an uninterrupted manner, whilst the button stem wrapping or winding process is made separate from the sewing on of the button and could even be combined with another working process, preferably the quality control.

Thus, according to a further development of the inventive concept, an apparatus for performing the method is proposed which, whilst obtaining a reliable fixing of the winding thread ends to the button stem coils, it is possible to more economically carry out the sewing of such buttons than when using the aforementioned stationary stem winding machine.

According to a second aspect of the present invention, there is provided an apparatus for performing the method according to the first aspect of the invention, the apparatus comprising a winding bell for the winding thread, a winding bell drive motor with hollow shaft through which is passed the winding thread to the winding bell and a magazine for receiving a winding thread supply, the winding bell, drive motor with hollow shaft and magazine being combined to form a hand-operated device.

The thus designed hand-operated device no longer has to be installed at the location of the button sewing machine and can instead be used at a random work location following the sewing-on of the button.

The hand-operated device is given a particularly compact and easily handleable construction, if the magazine is constructed as a handle. Advantageously the winding bell, the drive motor and the magazine are arranged equiaxially. However, the magazine can also be at an angle, e g. at right angles to the common axis of the winding bell and the drive motor.

The handleability of the apparatus proposed for performing the method can be further improved in that the winding bell drive motor is located with its axis at right angles to the winding bell and is in non-positive, driving connection with the latter by means of a mitre gear.

The hand-operated device further improved in this way has a very compact construction and facilitates the guidance of the apparatus through an ergonometrically even more favourable handling using the drive motor as a handle. Advantageously the drive motor casing is constructed as a handle.

Appropriately the mitre gear is formed by a bevel wheel pair, whereof one bevel wheel is fitted in non-rotary manner to the hollow shaft fixed to the winding bell, whilst the other bevel wheel is fixed to the drive motor shaft.

According to a further development of this apparatus the hollow shaft is mounted in rotary manner in a gear casing and its two ends pass out of the same, the winding bell being fixed to one end, whilst the other end is adjacent to the magazine receiving the winding thread supply.

Appropriately the drive motor casing is connected to the gear casing, which further improves the compactness of the apparatus.

The magazine is advantageously constructed in such a way that it is formed by a bobbin arranged at right angles to the common axis of the winding bell and the hollow shaft and a bobbin carrier on which the bobbin is placed in a rotary and replaceable manner and which is fixed to the gear casing.

The apparatus constructed as a hand-operated device is eminently suitable for use in the directly succeeding winding or wrapping of the button stems of several buttons, the stems being wound successively without separating the winding thread. The winding thread located between in each case two button stems is drawn from the latter and separated at them. The separation which is preferably brought about by tearing off can directly follow the sewing on of a plurality of buttons, but can also take place at a random latter time, without prejudicing the reliable fixing of the thread ends.

BRIEF DESCRIPTION OF THE DRAWINGS

For a better understanding of the invention and to show how the same may be carried into effect, reference is now made, by way of example, to the accompanying drawings, in which:

FIG. 1, FIG. 3 is a longitudinal section through a first embodiment of the apparatus constructed as a hand-operated device.

The same parts are given the same references throughout the drawings.

DESCRIPTION OF THE PREFERRED EMBODIMENTS

Figure 1:
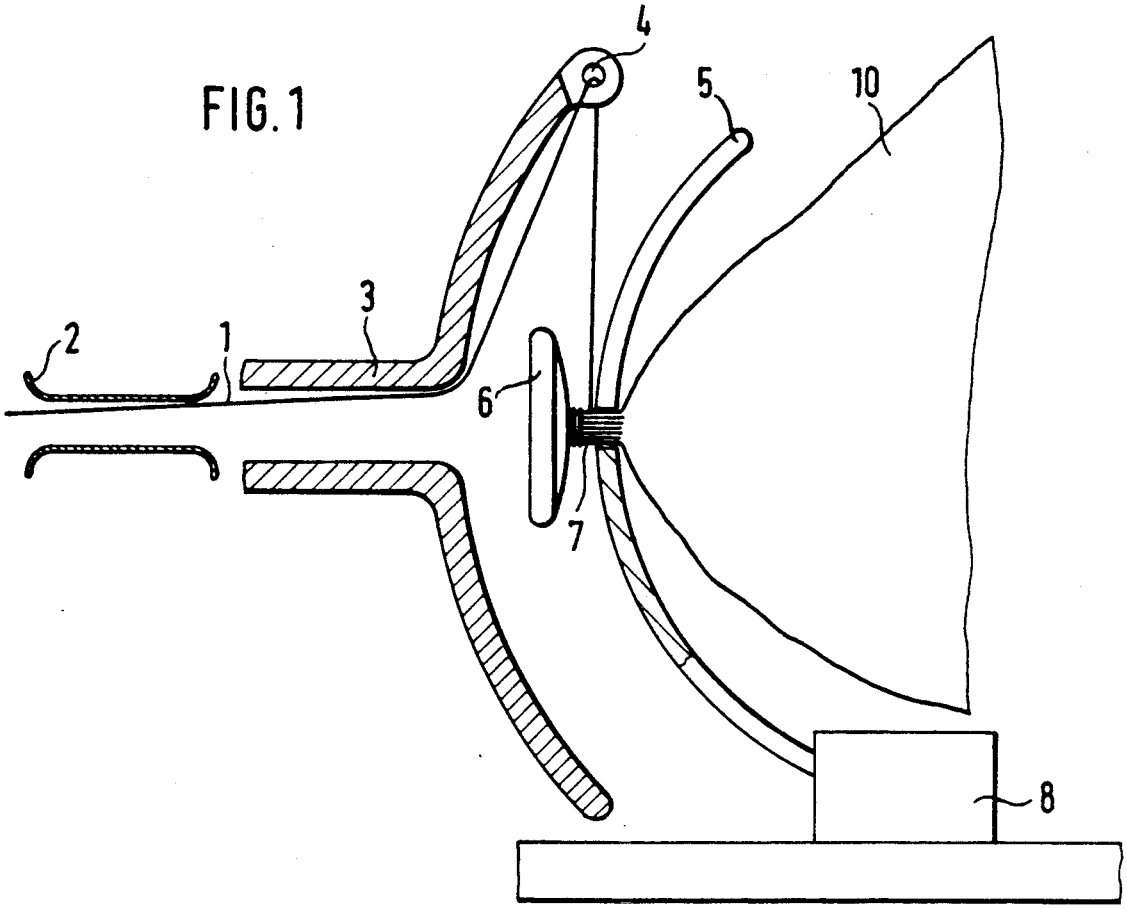
FIG. 1 is a diagrammatic longitudinal section through a stationary apparatus during the winding process of an apparatus for winding or wrapping a button stem.

The stationary apparatus shown in FIG. 1 has a winding bell 3 rotatable about the apparatus axis and which is provided with a concentrically fitted hollow shaft, through which is passed the winding thread 1, which is required for winding or wrapping the button stem. A thread tensioning device 2 is used for the fine setting of the thread tension. After passing out of the hollow shaft the winding thread is passed through a ring 4 on the edge of the winding bell 3 and is loosely inserted in the slot of the plate 5.

The plate 5 is a thin-walled, cambered metal plate having a vertically positioned slot and serves as a support for the already sewn-on button 6 and the initially still loose thread bundle 7 formed by the sewing thread. Before the start of the winding process the sewn-on button 6 is so inserted with the thread bundle 7 in the slot of the plate 5, that the button and the thread bundle 7 project into the cavity of the winding bell 3. On the back of the plate is located the area of the article of clothing 10 carrying the button 6.

Figure 2:
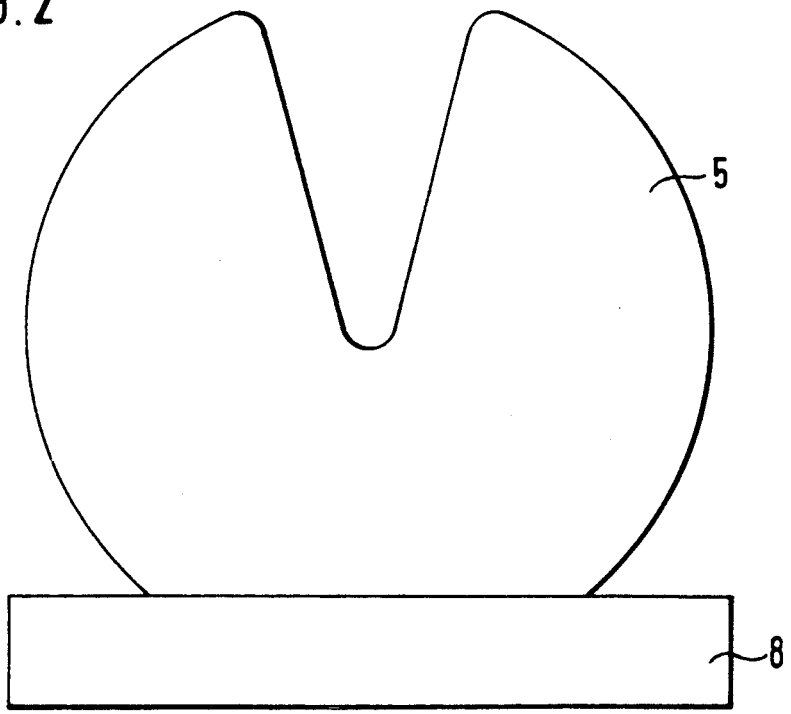
FIG. 2 is a diagrammatic front view of a metal plate of the apparatus used for holding the button and the button stem during the winding process, cf.

The cambered plate 5 is fixed to an apparatus 8 shown in FIGS. 1 and 2, which can be moved backwards and forwards in the direction of the winding bell 3 and can also be inclined. As a result of this movement the button 6 with the thread bundle 7 can be moved to a greater or lesser extent in to the cavity of the winding bell 3.

Following the described insertion of the button 6 and the thread bundle 7 in the slot of the plate 5, the winding bell 3 is rotated. As a result of the axial relative movement between the winding bell 3 and the apparatus 8 carrying the plate 5 from the winding thread is formed a coil extending over the entire length of the thread bundle 7 until the button stem produced from said bundle and the coil is completed. The winding or wrapping of the thread bundle only takes a short time and the button is raised upwards out of the plate 5. The still not separated or broken winding thread is now directly grasped at the button stem and is drawn away roughly at right angles to the axis of said stem and tangentially to its circumference by a corresponding tension action to the extent that no further elongation occurs. By further increasing the tension the winding thread is subsequently torn off directly at the button stem. The complete process is very simple and continuous, namely raising from the plate, drawing away of the thread and tearing off the thread at the stem. The resulting button stem is characterised by suppleness, flexibility and durability. It is not possible to loosen again the coil formed from the winding thread due to the previously described clamping of the last winding thread turns forming the thread end between the previously placed thread turns.

Figure 3:
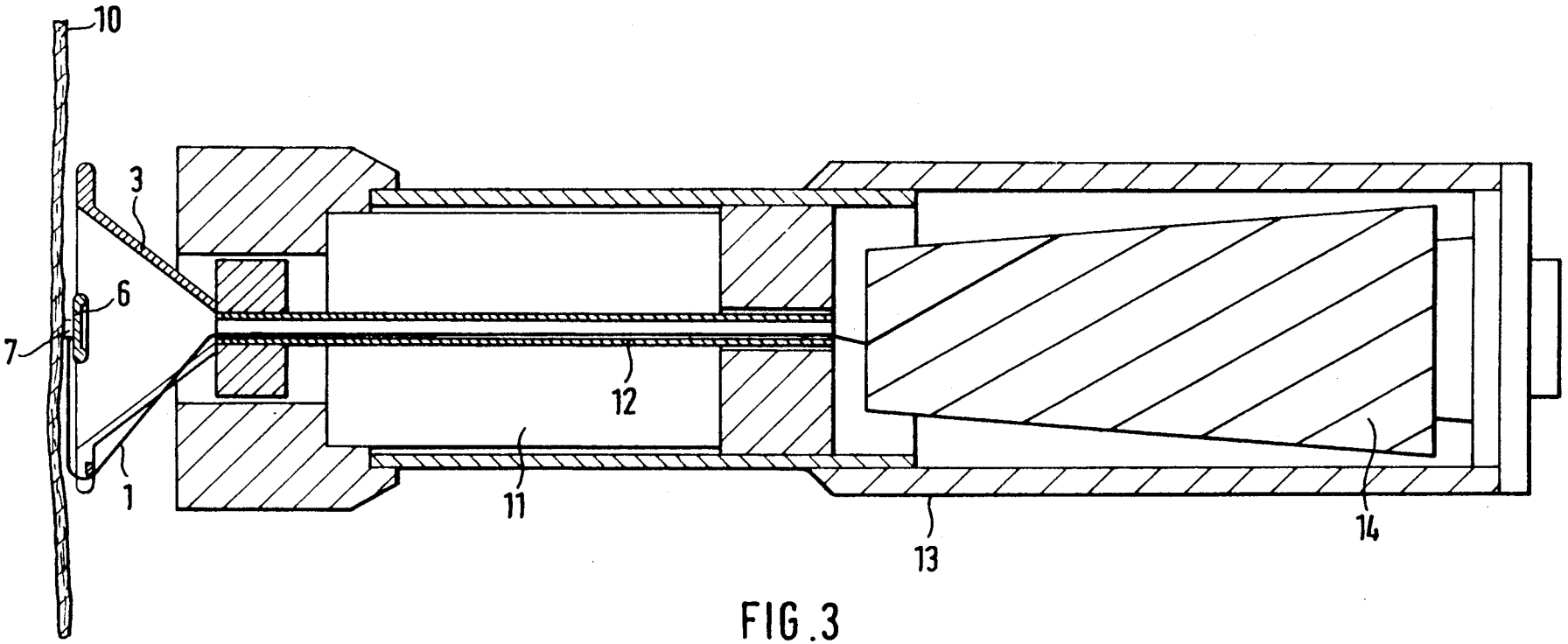

In order to illustrate the first embodiment of the apparatus constructed as a hand-operated device reference will be made to FIG. 3. An electric motor 11, preferably a direct current motor of low voltage, drives the winding bell 3 with the aid of a hollow shaft 12. The elastic winding thread 1 is drawn off a bobbin 14 located in a magazine 13 and passed through the hollow shaft 12 to the winding bell 3, where it passes out at the edge of the latter during the winding process and is wound around the thread bundle 7 of the button stem.

The winding process with this first hand-operated device is performed as follows. The yarn end, i.e. the free end of the winding thread 1, is fixed by slight pressure on the article of clothing 10 by means of a finger and the winding bell 3 is brought into slight contact with the surface of the article of clothing 10 and the sewn-on button 6 should be in the centre of the bell. The electric motor 11 is then put into operation for a certain time by means of a separate control (not shown), so that the winding process is completed. The winding bell 3 is then raised from the button 6 and preferably, without tearing off the thread 1 is placed on the next button. This process can be continued at random, so that it is possible to process successively a random number of articles of clothing. It is therefore possible to carry out the wrapping of the button stems on articles of clothing, which are hung on the conveyor, without it being necessary to tear off the yarn or thread 1. The tearing off of the thread between the buttons takes place at a random later time. With the exception of the first wound stem, both thread ends, i.e. the start and finish are non-detachably fixed to each button stem. Obviously the inventive apparatus can be used with corresponding good results for winding the stems of individual buttons.

Figure 4:
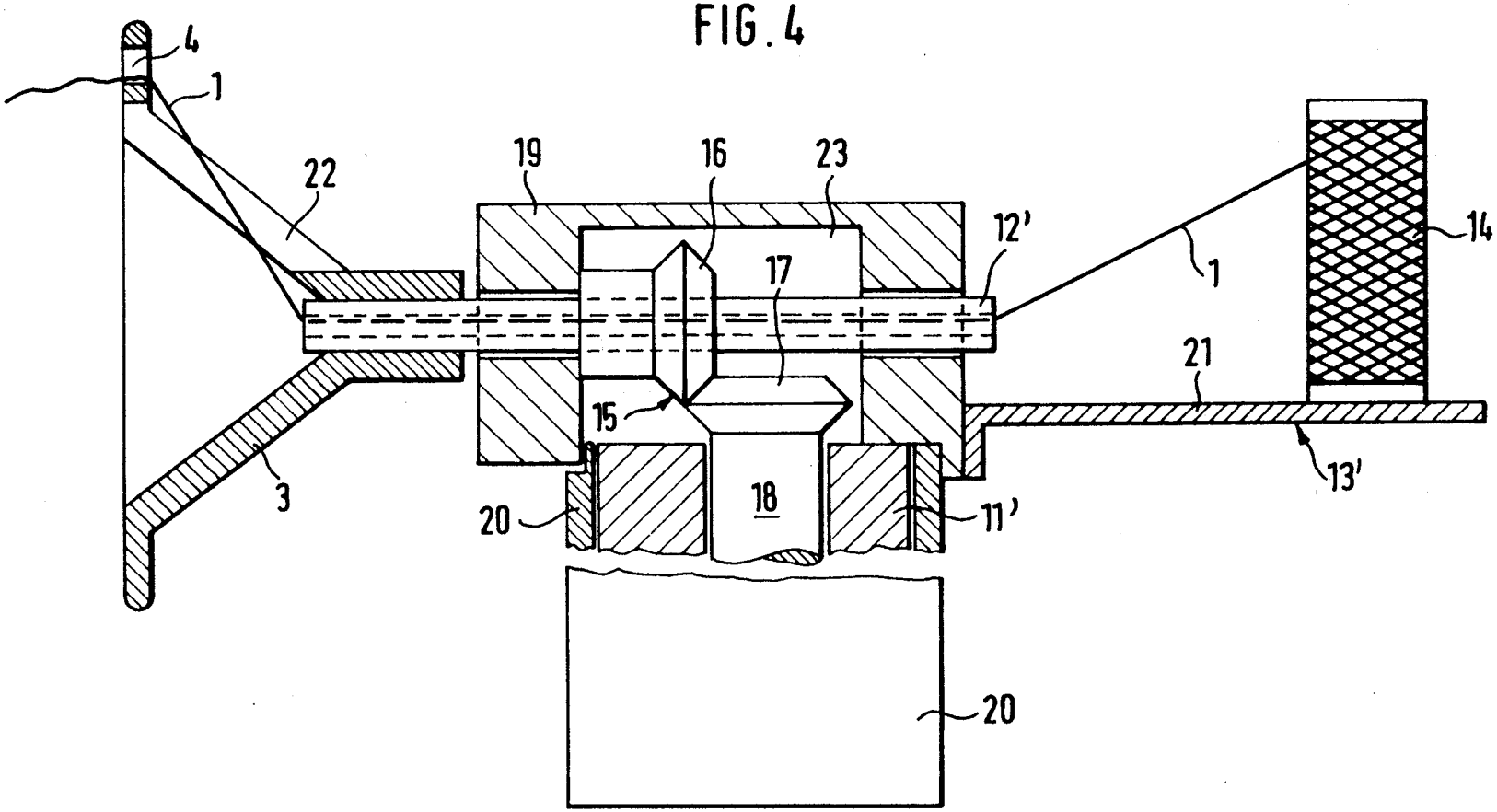
FIG. 4 is a partial longitudinal section through a second embodiment of the apparatus constructed as a hand-operated device.

The second embodiment of the apparatus constructed as a hand-operated device will now be described with reference to FIG. 4. A hollow shaft 12' is mounted in rotary and axially non-displaceable manner in a gear casing 19. The two ends of the hollow shaft 12' is lead out of the gear casing 19 and on one end is fixed a winding bell 3, whilst the other end is adjacent to a magazine 13' for receiving a winding thread supply. The magazine 13' comprises a bobbin carrier 21 fixed to the gear casing 19 and a supply bobbin 14 for the winding thread 1, which is positioned at right angles to the axis of the hollow shaft 12' and which is fitted in rotary, replaceable manner to the bobbin carrier 21. The winding thread 1 running off the bobbin 14 is led through the hollow shaft 12', through a slot 22 located in the wall of the winding bell 3 and finally through a ring 4 provided on the circumference of said bell 3.

The hollow shaft 12' traverses a cavity 23 in the interior of the gear casing 19 and in which is located a mitre gear 15 formed from two bevel wheels 16, 17. The bevel wheel 16 is fixed concentrically to the hollow shaft 12', whilst the bevel wheel 17 is fixed to the motor shaft 18 of a drive motor 11', which is preferably constructed as a direct current motor. The drive motor 11' is surrounded by a motor casing 20, which is connected to the gear casing 19. In this arrangement the axis of the hollow shaft 12' and the axis of the drive motor 11' form a right angle. The motor casing 20 of the drive motor 11' shown only in broken away form in the drawing is constructed as a handle, which as a result of its fitting location to the overall apparatus allows an easy and precise handling and guidance thereof. The drive motor 11' can be constructed as a cable-less battery motor.

The winding process performable with the hand-operated device according to FIG. 4 corresponds to that described with reference to FIG. 3.

I claim:

1. An apparatus for winding a thread around a button stem sewn by a sewing thread to an article of clothing comprising a winding bell rotatable about an axis for winding an elastomeric plastic material thread around and in the axial direction of the button stem, a winding bell drive motor having a axis with the drive motor spaced from said winding bell, said drive motor has a hollow shaft arranged for the winding thread to be passed therethrough to the winding bell, said hollow shaft having an axis, and a magazine having an axis and arranged for receiving a winding thread supply and arranged to supply the winding thread to the hollow shaft, and the winding bell, drive motor and hollow shaft and magazine, in combination, forming a hand-operated device.

2. An apparatus according to claim 1, wherein the magazine is constructed as a handle.

3. An apparatus according to claim 1, wherein the axis of the winding bell, the drive motor and the magazine are arranged coaxially.

4. An apparatus according to claim 1 wherein the axis of the winding bell drive motor is arranged at right angles to the axis of the winding bell and is in non-positive driving connection with the said bell by a mitre gear.

5. An apparatus according to claim 4, comprising a casing surrounding the drive motor, the casing being constructed as a handle.

6. An apparatus according to claim 4, wherein the mitre gear is formed by a pair of bevel wheels, with one bevel wheel fitted manner to the hollow shaft which is fixed to the winding bell, and the other bevel wheel fixed to the shaft of the drive motor.

7. An apparatus according to claim 4, wherein the hollow shaft is mounted in rotary manner in a gear casing and has two ends each extending out of the casing, the winding bell being fixed to one said end, and the other said end positioned adjacent to the magazine receiving the winding thread supply.

8. An apparatus according to claim 7, wherein a casing of the drive motor is connected to the gear casing.

9. An apparatus according to claim 4, wherein the magazine is formed by a bobbin positioned at right angles to a common axis of the winding bell and the hollow shaft, and a bobbin carrier, the bobbin is fixed in a rotary and replaceable manner to said bobbin carrier and said bobbin carrier is firmly connected to a gear casing.

10. A method of winding a thread around an axially extending stem of a button sewn by a sewing thread to an article of clothing comprising the steps of winding a thread made from an elastomeric plastic material under tension around a thread bundle formed from the sewing thread between the button and the article of clothing, subsequently fixing the thread end to the thread bundle after winding the thread around the thread bundle by drawing off the winding thread from the stem in a direction substantially at right angles to the stem axis and increasing the tension of the thread beyond its yield point before it is separated at the button stem.

11. A method according to claim 10, including the step of separating the thread by tearing off the thread end by increasing the tension in the thread to the breaking limit.

12. A method according to claim 10, wherein using a winding thread with an elongation in the range of approximately 100% to 600%.

13. A method according to claim 12, wherein using a winding thread with an elongation in the range of 400% to 600%.

* * * * *